US006095280A

United States Patent [19]

Proni

[11] Patent Number: 6,095,280

[45] Date of Patent: Aug. 1, 2000

[54] CONCENTRIC TUBE SUSPENSION SYSTEM FOR LOUDSPEAKERS

[76] Inventor: Lucio Proni, 2571 Mayfair La., Weston, Fla. 33327

[21] Appl. No.: 09/049,673

[22] Filed: Mar. 27, 1998

Related U.S. Application Data

[63] Continuation of application No. 08/684,147, Jul. 19, 1996, Pat. No. 5,734,132.

[51] Int. Cl.[7] ..... G10K 13/00; H04R 25/00

[52] U.S. Cl. ..... 181/171; 381/403; 381/432

[58] Field of Search ..... 181/171, 166; 381/403, 432

[56] References Cited

U.S. PATENT DOCUMENTS 4,239,943 12/1980 Czerwinski ..... 381/403

5,323,469 6/1994 Scholz ..... 381/432

*Primary Examiner*—Khanh Dang

*Attorney, Agent, or Firm*—Holland & Knight LLP

[57] ABSTRACT

A concentric tube suspension system and loudspeaker system of the moving coil type, including a diaphragm supported by a frame, a voice coil including a former and voice coil winding supported by the former, and a suspension system for stabilizing and centering the voice coil in a magnetic gap while it is linearly displaced by an electromagnetic motor. The suspension system generally comprises a tubular stabilizer attached to the bottom surface of the diaphragm so as to concentrically straddle the voice coil and electromagnetic motor, and a lower corrugated suspension attached at one end to the frame and at the other end to the lower end of the stabilizer, wherein the stabilizer and lower suspension provide a centering force below the traditional neck joint location on the voice coil.

18 Claims, 9 Drawing Sheets

Fig. 2a (INSTANT INVENTION)

CONCENTRIC TUBE SUSPENSION SYSTEM FOR LOUDSPEAKERS

This application is a continuation of U.S. application Ser. No. 08/684,147 filed Jul. 19, 1996 now U.S. Pat. No. 5,734,132.

BACKGROUND OF THE INVENTION

1. Field of the Invention

The present invention generally relates to loudspeakers and loudspeaker suspension systems, and more particularly, to a loudspeaker and suspension system that separates the lower suspension from the diaphragm and voice coil with a concentric tube member to provide a restoring force both above and below the moving assembly's center of rotation.

2. Description of the Prior Art

As high-excursion loudspeakers are more commonly used, weaknesses in traditional loudspeaker suspension are becoming more apparent. When large amounts of cone movement are required, lateral stability of the moving components (that is, the coil and former) becomes critically important. This is because clearances between the voice coil and magnetic gap boundaries are minimal, as seen in the prior art speaker of FIG. 1. Consequently, any deviation from the desired linear motion (i.e., rocking) can cause the voice coil to rub against the top plate and/or pole piece.

This rubbing can produce unacceptable levels of audible noise and may even lead to driver failure if the instability is severe.

In the typical loudspeaker, one cause of the moving component instability is the small physical distance between the suspension components, leaving little tolerance for rocking. The conventional suspension system comprises a roll 3 (outer suspension) and spider 2 (inner suspension). The roll 3 and spider 2 are the members responsible for controlling and stabilizing the position of the cone and voice coil relative to the motor structure. When the moving assembly begins to rotate away from its ideal linear path during its travel, the roll and spider are called on to resist and prevent rocking. The roll and spider, however, only have a limited amount of restoring force available to resist the rocking motion. This limited resistance to rocking is exacerbated by their close physical proximity to the center of rotation. Being located near the rotational center does not afford any leverage for augmenting the meager restoring force of the spider. In addition, the rotation center is volatile, whereby changes in excursion shift the rotation center, altering moment forces on the roll and spider. Notwithstanding, the spider remains relatively close to the center of rotation, such that any mechanical advantage in the typical suspension system is minimized by its proximal relationship to the axis of rotation.

High excursion loudspeakers further amplify problems with rocking, as high-excursion loudspeakers require relatively long voice coil winding lengths. A very significant portion of the moving assembly's weight consists of the copper wire in the voice coil. Longer winding lengths dictate that the copper wire in the coil be distributed over a greater linear distance along the voice coil former's axis. Consequently, more of the coil's weight is placed further away from the spider, affecting the position of the rotation center. This increases the pendulum-like behavior of the system and makes rocking modes harder to control.

High-excursion loudspeakers often compensate for rocking mode problems by increasing the width of the magnetic gap in which the voice coil resides. A larger clearance between the coil and the motor structure allows the speaker to tolerate more movement of the voice coil without contact. However, there is a downside to increasing the width of the magnetic gap. A larger magnetic gap decreases the magnetic flux density in the gap, and hence the driver's motor strength. Decreased power handling capability is another trade-off when enlarging the gap. This is because the metal parts are now farther away from the voice coil, making them less effective in transferring heat away from the coil body. Consequently, heat builds up in the voice coil, causing adhesives to soften, and creating more power-related failures.

Conventional high-excursion loudspeakers also require excessive loudspeaker mounting depth. The important clearance dimensions in a speaker design include the clearance between the neck joint (intersection of cone, spider, and voice coil former) and top plate, and between the bottom of the voice coil and the back plate. These clearances must be greater than or equal to the driver's maximum physical excursion capability. The speakers with a large cone excursion require a larger corresponding clearance within the frame structure to prevent moving parts from making contact during peaks. As the excursion capability increases, so does the depth of the loudspeaker structure. This problem can be troublesome in certain markets, such as car audio, since consumers typically desire the placement of very high performance drivers in extremely tight places.

Finally, it is also desirous to provide alternative ways to vent air pressure from under the diaphragm. An air volume defined by the traditional diaphragm, dust cap, voice coil inner diameter, and pole piece changes size as the loudspeaker's moving structure travels through its excursion range. If this pressure is not released, the cone's motion will be impeded, changing the woofer's performance specifications dynamically depending on excursion. This air pressure is usually vented through a vent machined in the pole piece. However, machining the vent increases the cost of the motor structure and can increase magnetic circuit losses due to the removal of metal from the pole. the instant invention offers several alternate means of venting this air pressure.

Several speaker designs may be available in the background art for increasing stability. However, none are known to solve the above-noted problems. In fact, there is no design known which is directly comparable to the concentric tube concept. Past attempts to increase the mechanical stability of loudspeakers have generally utilized dual spiders separated by some predetermined distance. However, any advantage realized in these designs is limited and offset by the need for an additional spider with little separation from the first spider. As the above-noted devices neither solves nor adequately addresses the problems contemplated by the present invention, there remains a need for a loudspeaker with increased stability and resistance to rocking.

SUMMARY OF THE INVENTION

An object of the instant invention is to provide a concentric tube suspension system for loudspeakers to reduce moving assembly rocking in a speaker's magnetic gap and to provide a stronger joint between the suspension system and moving assembly.

Another object of the invention is to provide a loudspeaker with a suspension system that eliminates the diaphragm, spider, and voice coil junction , i.e. neck joint, as a failure point.

A further object of the invention is to provide a suspension system for use in loudspeakers including, but not limited to, high-excursion loudspeakers, for increased linear and lateral moving assembly stability to reduce rocking.

It is another object of the invention to provide a suspension system that improves the mechanical stability in loudspeakers.

It is a further object of the invention to provide a suspension system that enhances the glue joint between the lower/spider suspension and the moving assembly.

It is yet another object of the invention to provide a suspension system that is adaptable to high-excursion loudspeakers for enhanced moving assembly stability and speaker performance.

It is yet an additional object of the invention to increase the separation between the upper suspension and lower suspension and to separate the lower suspension from the diaphragm for enhanced leverage.

It is yet a further object of the invention to separate the lower/spider suspension from the electromagnetic driver structure.

It is still another object of the invention to provide a concentric tube stabilizer that increases separation between the upper/roll and lower/spider suspensions to improve the loudspeaker's resistance to rocking by maximizing the suspension's leverage over the moving assembly.

It is also an object of the invention to make it easier to use an additional spider while providing larger separation between the spiders and flexibility in diaphragm selection.

It is still an additional object to provide a suspension system that facilitates a loudspeaker with decreased mounting depth.

In light of these and other objects, the instant invention generally comprises a concentric tube suspension system for use in loudspeakers to increase resistance to moving assembly rocking.

The loudspeaker generally comprises the new suspension system, a voice coil including the former and winding, a diaphragm extending from an upper suspension to the voice coil, a concentric tube stabilizer depending from the diaphragm to a lower suspension, a frame and an electromagnetic motor structure. The moving assembly basically includes the voice coil, diaphragm and the suspension system. The suspension system generally comprises the upper/roll suspension which connects the upper edge of the diaphragm to the frame and a lower/spider suspension connected at one end to the lower end of the tube stabilizer and at the other end to the frame. The tube stabilizer depends downward from the diaphragm so as to be concentric about the electromagnetic driver structure. The stabilizer may be attached to the diaphragm by several different means including, but not limited to, adhesives, adhesive impregnated foam or a ventilation ring. The stabilizer descends to the spider and attaches at a level substantially below the uppermost surface of the motor structure and at a level adjacent to the lower portion of the voice coil windings. Thus, the spider attaches to the outer diameter of the concentric tube stabilizer, and not to the voice coil former. Accordingly, the suspension system extends vertically across the loudspeaker to provide support above and below the moving assembly's axis of rotation about which a speaker's moving assembly tends to rock. This configuration allows drastically improved mechanical stability and significant reduction in the driver mounting depth.

The present invention offers several advantages over conventionally designed loudspeakers. In conventional high excursion speakers, the spider (lower suspension) is often attached to the voice coil in the vicinity of the static rotational center of the moving structure. Since the spider is positioned proximal to the rotational center, it must resist twisting motion in addition to lateral movement. In the instant invention, the suspension system incorporates a novel concentric tube stabilizer that separates the lower suspension from the diaphragm and increases the separation between the upper suspension (roll) and the lower suspension (spider) to provide increased resistance to rocking without increasing the mounting depth of the loudspeaker. The design of the instant invention is based in part on the theory that leverage over a rotating body is maximized by moving suspension components to the ends of the body. This is accomplished by attaching the spider much farther down the moving assembly to afford greater separation between the upper/roll suspension and the lower/spider suspension. The increased separation increases the loudspeaker's linear stability (resistance to rocking) by maximizing the suspension system's mechanical advantage or leverage over the moving assembly. This mechanical advantage exists regardless of where the rotational center is located and can be realized without the use of an exotic spider. Furthermore, since the tube stabilizer straddles the motor structure, the risk of the spider coming in contact with the stationary metal parts of the driver is not a concern.

Another advantage is that the stabilizer does not limit the spider's attachment point to any one position in relation to the voice coil because it offers a continuous outer structure. This allows the spider to be attached below the moving assembly's rotational center at a number of selected points. Thus, the roll and spider in tandem can provide enhanced resistance to rotational or rocking movement over the moving assembly's excursion. This optimizes the performance of the suspension system and virtually eliminates rocking mode problems.

The instant invention also facilitates the design of loudspeakers having more shallow depths. Since the spider can be attached at points closer to the back plate of the speaker, a flat diaphragm or more shallow cone (implying a larger cone angle) may be used allowing the electromagnetic driver/motor structure to be shifted upward, closer to the cone apex, into formerly wasted space. The loudspeaker's mounting depth is therefore drastically reduced for a given roll-spider separation. Loudspeakers with minimal mounting depth are useful in situations where enclosure space is at a premium.

The instant invention also realizes the advantages that result from the use of a spider suspension having a larger inner diameter. Those advantages include a stronger glue joint and a more reliable spider suspension. Since the spider is attached to the tube stabilizer along its interior edge, the circumference of the glue joint is proportionately increased with a larger inner diameter. A longer glue joint distributes the stresses along a larger portion of spider material and lowers the demand on the glue bond, making the spider attachment more reliable. As the inner diameter increases, the circumference intersects more individual strands of material so that the spider is less prone to fatigue along the critical glue joint. Moreover, the spider with a larger inner diameter experiences more material deflection for a given amount of rocking. As a result the suspension is more resistant to rocking.

In addition to making the loudspeaker more reliable, greater stability can provide several other benefits. For instance, in the areas of magnetic design and thermal power handling, the increased stability allows for tighter magnetic gap tolerances which provide better thermal transfer and greater magnetic flux density in the gap. The loudspeaker can also be designed with a reduced mounting depth for use in areas of limited space without compromising performance. Thus, thinner speaker designs are possible with the instant invention. The instant invention further provides a loudspeaker system which reduces the amount of machining in the speaker's motor construction, whereby it facilitates the incorporation of alternative venting structure.

In accordance with these and other objects which will become apparent hereinafter, the instant invention will now be described with particular reference to the accompanying drawings.

DESCRIPTION OF THE PREFERRED EMBODIMENTS

Figure 1:
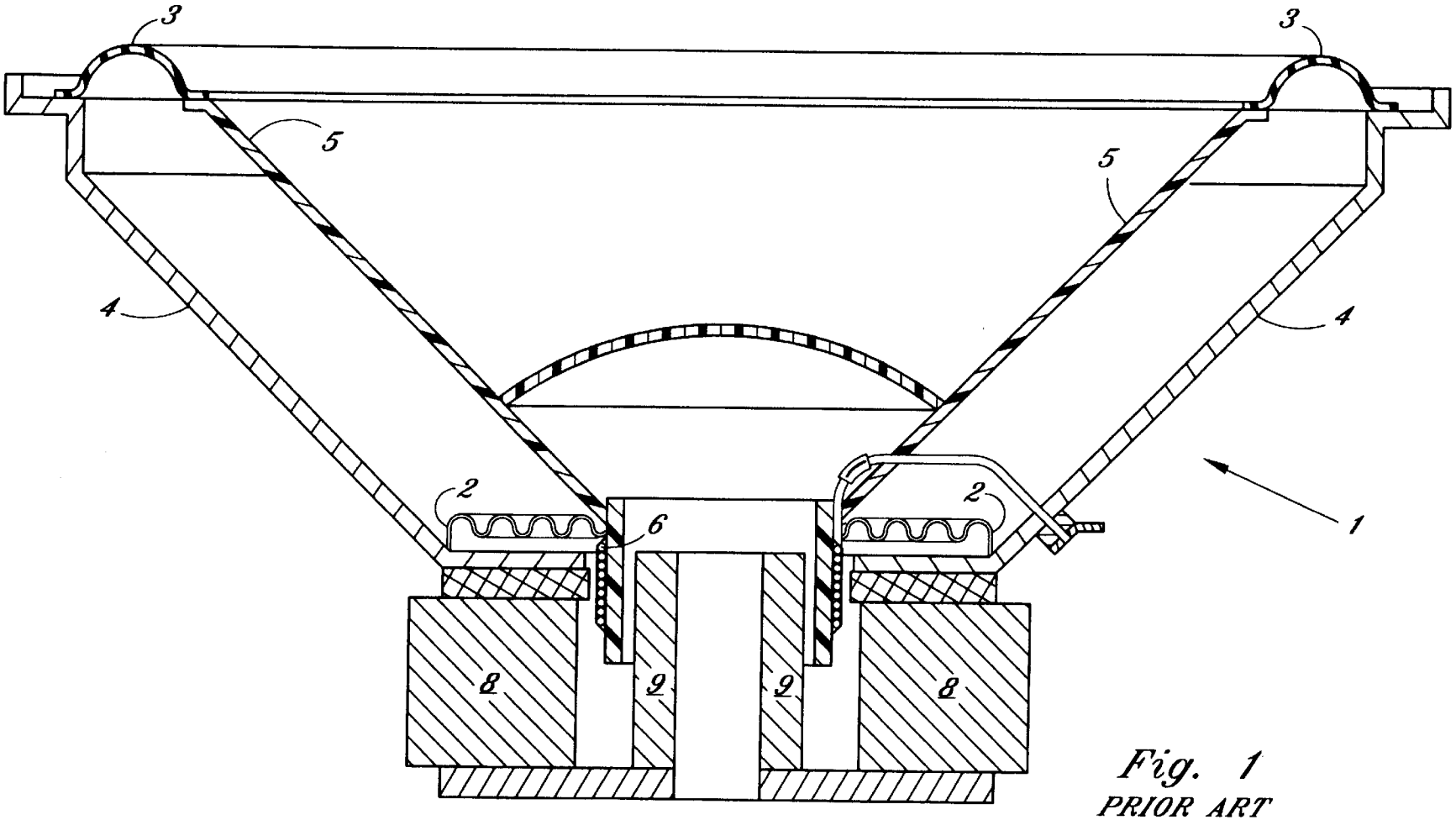
Fig. 1 PRIOR ART
FIG. 1 is a cross sectional view of a prior art loudspeaker.

With reference to the drawings, FIGS. 2–9*c* depict the loudspeaker 10 of the instant invention. The loudspeaker 10 generally comprises a moving assembly, an electromagnetic driver/motor structure 26, 28, 29 for cycling the moving assembly, a novel suspension system 16, 30, 40 for stabilizing the moving assembly, and a frame 18 to provide overall structural support for the foregoing. The moving assembly generally comprises a voice coil 20 and a diaphragm 12, and the voice coil 20 includes a voice coil winding 24 supported by a former 22.

Figure 2B:
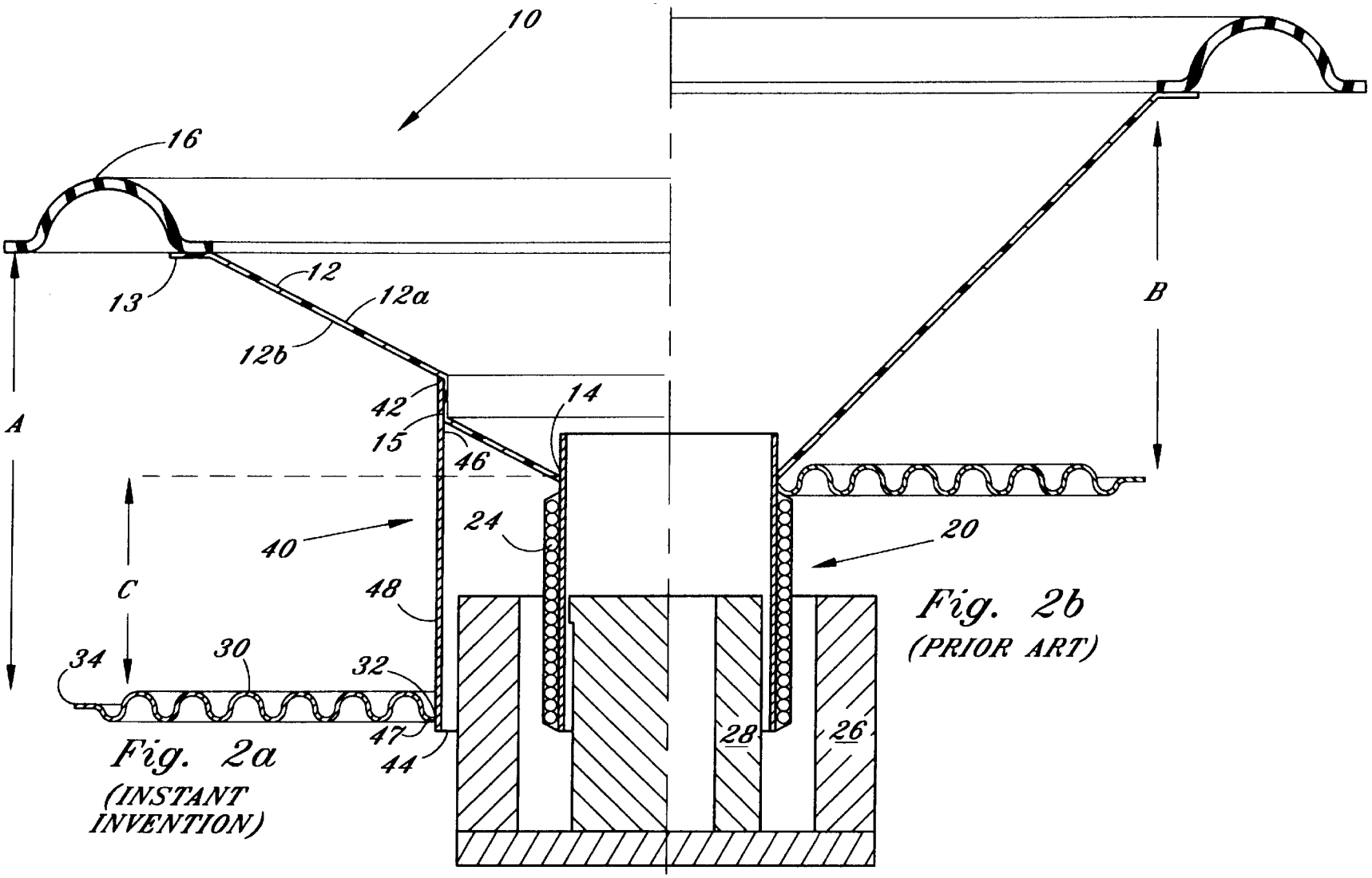
Fig. 2b (PRIOR ART)
FIG. 2*a* is a partial cross sectional view of a prior art speaker aligned with FIG. 2*a* of the instant invention for side-by-side comparison.
Figure 3:
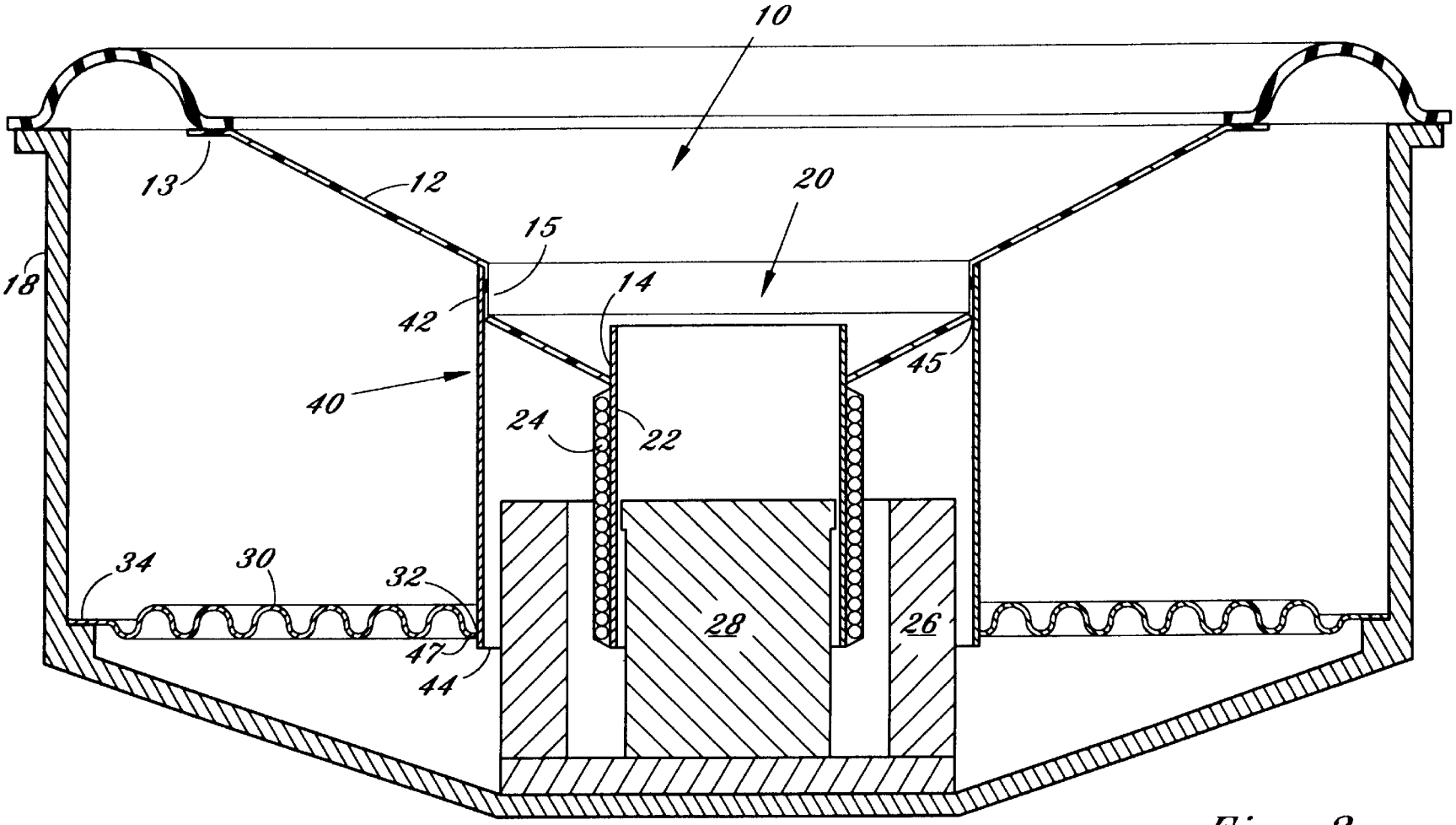
FIG. 3 is a cross sectional view of one embodiment of the loudspeaker of the instant invention.

The loudspeaker 10 provides enhanced performance by incorporating a novel concentric tube suspension system that minimizes rocking of the speaker moving assembly by maximizing leverage. Referring to FIG. 3, the instant suspension system generally comprises an outer continuous tubular cylinder or concentric tube stabilizer 40, an upper/roll suspension 16, and at least one lower/spider suspension 30. FIG. 2 is divided to represent the present invention on one side and a conventional loudspeaker on the opposite side. Distance "A" represents the distance between the roll and the spider for the concentric tube speaker. Distance "B" represents a smaller distance between the roll and spider in conventional speakers. Finally, distance "C" illustrates the separation advantage held by the concentric tube design. With reference to the suspension system of the instant invention, the upper suspension 16 comprises an arcuate roll attached to the outer peripheral edge of the diaphragm on an inside edge and to the frame 18 on its outside edge. The spider 30 comprises a donut-shaped, corrugated, lightweight anchor or suspender. The stabilizer 40 is attached near its lower end 44 to the spider 30 and at its upper end to the diaphragm 12. The stabilizer 40 eliminates the traditional neck joint as a stress or failure point and prevents rocking of the moving assembly as discussed hereto. The tube stabilizer 40 is substantially cylindrical and depends from the bottom surface 12*b* of the diaphragm 12 so as to be concentrically positioned around the electromagnetic motor structure 26 and, hence, voice coil 20. The tube stabilizer 40 is preferably attached to the diaphragm 12 by an adhesive, such as epoxy, at a predetermined mid-point for optimal voice coil 20 stability and speaker sound quality. The lateral position of the tube stabilizer 40 is directly related to the diameter of the motor structure 26 and depends from the diaphragm bottom surface 12*b* so that it straddles the motor 26 structure without making contact.

Figure 4:
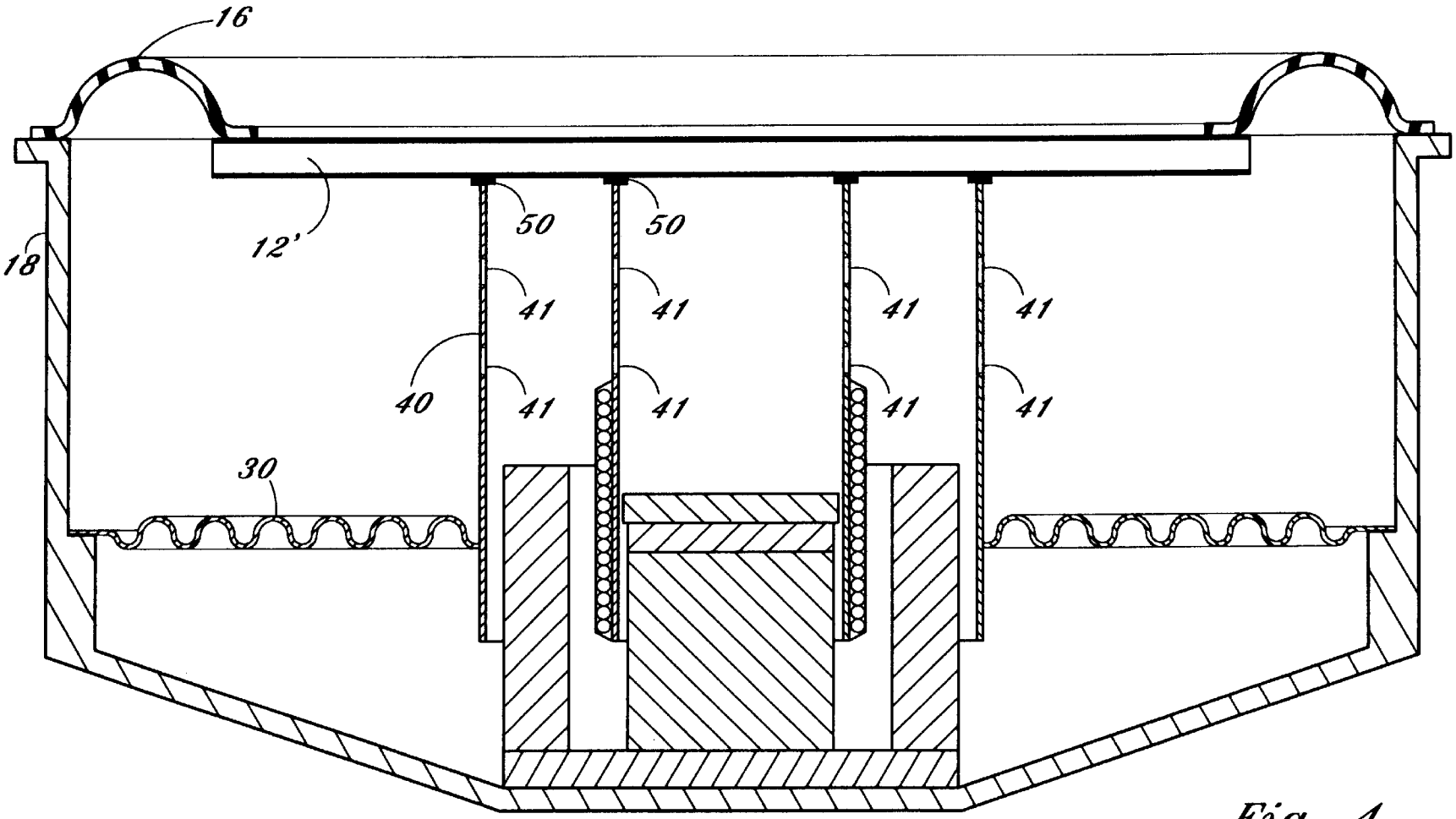
FIG. 4 is a cross sectional view of another embodiment of the loudspeaker of the instant invention.
Figure 5:
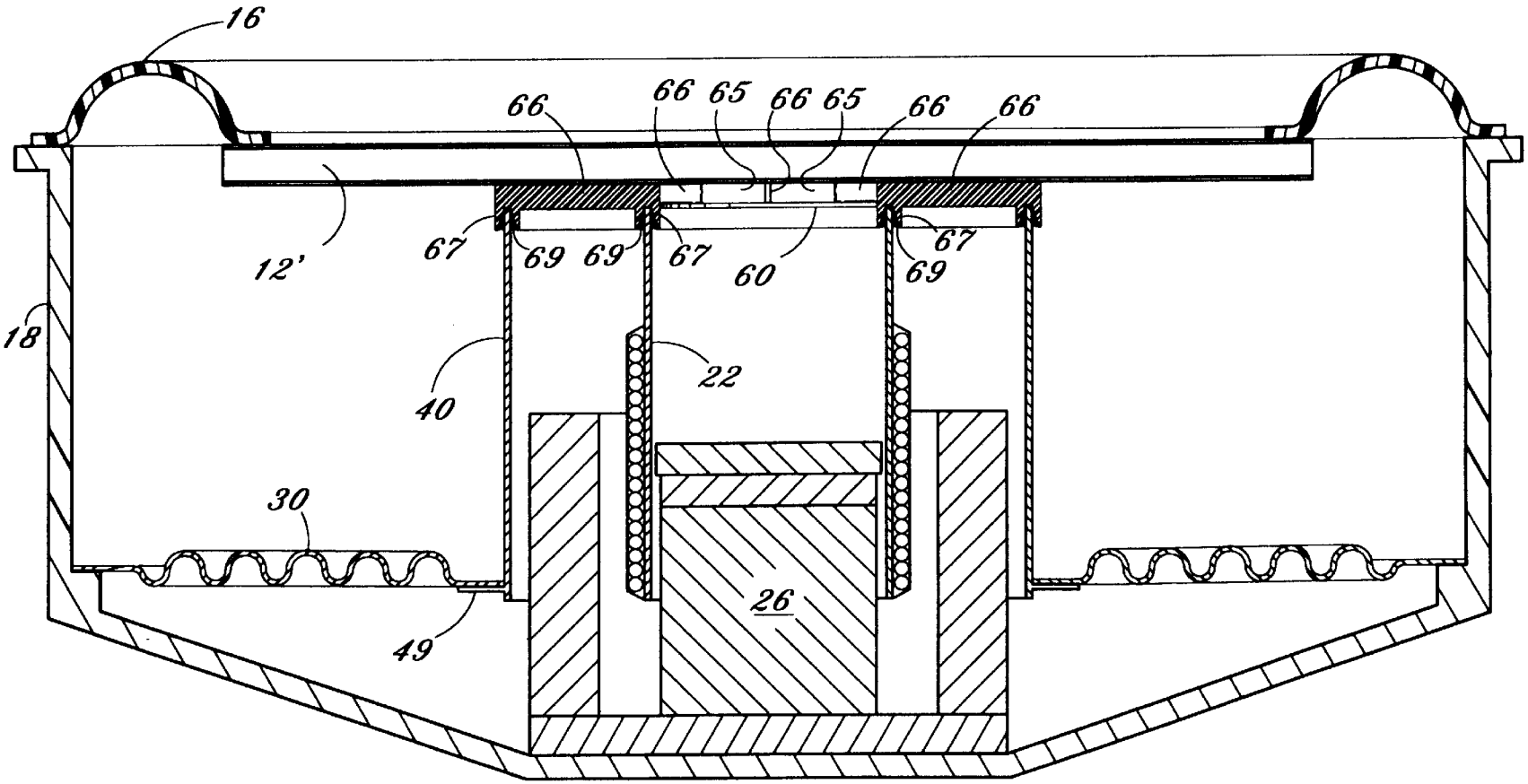
FIG. 5 is a cross sectional view of another embodiment of the invention.

Several alternate means for attaching the stabilizer 40 to the diaphragm 12 may be employed and interchanged between speakers as discussed herein. For instance, with a cone-like structure, the diaphragm 12 preferably defines a cylindrical elbow 15 by making a substantially downward vertical bend from its usual obtuse plane for a predetermined length before angling back toward the voice coil 20. The elbow 15 provides a vertical surface for attaching the tube stabilizer 40 along its interior wall 46 at the upper peripheral edge 42. Accordingly, the cylindrical elbow 15 defines an outer diameter that is essentially equal to the inner diameter of the tube stabilizer 40, at least at the upper edge 42. An upper stabilizer joint 45 is thus formed at an elevation above the former neck joint. More importantly, the concentric tube stabilizer 40 separates the spider 30 from the cone 12 and roll providing greater lateral support in the moving assembly. The separation provided by the tube 40 enhances the reinforcement and stabilization force of the spider 30 for greater control. This lateral control is also achieved because the cone and stabilizer act as a rigid body. The stabilizer 40 may also be attached to the diaphragm with an adhesive impregnated foam 50 or a ventilation adaptor ring 60 as shown in FIGS. 4 and 5, respectively.

Referring to FIGS. 2 and 3, the tube stabilizer 40 depends concentrically around the motor structure 26 at its lower edge 44 below the former neck joint and rotation axis. The lower suspension or spider 30 preferably attaches to the tube stabilizer 40 proximal its lower edge 44 along its inner diameter edge 32. The spider's inner diameter 32 is essentially equal to the stabilizer's outer diameter 48, at least along the lower edge 44 where attached, and is greater than the conventional diameter. A lower stabilizer joint 47 is formed by the joining of the spider inner diametric edge 32 and the tube stabilizer's outer surface 48. The lower stabilizer joint 47 is positioned below the former neck joint and axis of rotation as seen in FIG. 2. Since the outer tubular stabilizer 40 straddles the motor structure 26, the spider's 30 potential contact with the motor structure is no longer a concern. Consequently, the spider 30 may be attached at a point much farther down on the moving assembly and below the axis of rotation. This provides greater separation between the upper suspension/roll 16 and the spider 30. The larger separation between the roll 16 and the spider 30 increases the loudspeaker's linear stability and resistance to rocking by maximizing the suspension's mechanical advantage or leverage over the moving assembly. Thus, higher excursions are achievable without the risk of unacceptable rocking.

The mechanical advantages gained by incorporating the tube stabilizer 40 are shown in FIG. 2. The tube stabilizer 40 essentially elongates the stabilizing force to provide an increase in the lateral stabilization. As illustrated by separation distance A, the concentric tube stabilizer 40 moves the lower suspension component (spider 30) to the lower end of the rotating body (moving assembly) to complement the upper suspension (roll 16) in maximizing leverage over the system. As shown, the distance A between the upper suspension and spider in the instant invention is greater than the comparable distance B in conventional systems. The resulting structural advantage is represented by C. In addition to the mechanical advantage gained, this design facilitates reduced mounting depth without compromising performance and tighter magnetic gap tolerances for improved thermal transfer and increased magnetic flux. In addition, the neck joint is eliminated as a potential failure point. By contrast, the prior art speaker shown in FIG. 2 attempts to stabilize the moving assembly at the neck joint proximal to the axis of rotation. Thus, the prior art suspension system is at a mechanical disadvantage.

The concentric tube suspension system of the instant invention provides several other advantages over the prior art. One of the main advantages is that a spider 30 with a larger inner diameter may be used for securing to the moving assembly. With a larger inner diameter, the circumference of the inner diametric edge 32 is increased, providing a longer glue joint. The longer glue joint 47 distributes stress along a larger portion of the spider 30 material, lowering the demand on the glue bond. This makes the spider joint 47 attachment much more reliable. In addition, as the inner diameter of the spider 30 increases, the circumference of the inner diameter intersects more individual strands of material, making the spider 30 less prone to material fatigue along the critical inner diameter glue joint 47. Another advantage realized is that a larger inner diameter spider requires more material deflection for a given amount of rocking motion. As a result, the suspension provided is more resistant to rocking modes. Moreover, in addition to making a loudspeaker more reliable, greater stability in the suspension system can also provide benefits in areas of magnetic design and thermal power handling.

The tube stabilizer 40 has a continuous structure that allows the spider 30 or additional spiders to be attached at any one position in relation to the voice coil 20 without an increase in mounting depth or structure thickness. The stabilizer 40 facilitates the use of more than one spider 30 to meet design goals. Given the large surface area of the stabilizer 40, it is simple to use and attach additional spiders 30. Since a spider 30 attachment can be made much lower on the moving assembly, the spider 30 can be placed on the lower side of the moving assembly's rotational center. Consequently, the roll 16 and the spider 30 in tandem provide greater resistance to rotational or rocking movement over the moving assembly's excursion. This optimizes the suspension system stability and virtually eliminates rocking problems. In an alternative embodiment, the outer continuous surface 48 of the tube stabilizer 40 may define a peripheral ledge 49 at a predetermined elevation below the rotational axis for setting and adhering the spider 30.

Referring to FIG. 3, the spider's outer diametric edge 34 is attached to the frame 18. A ledge 19 is formed by the frame 18 for setting and adhering the spider edge 34. As the drawings illustrate, the concentric tube stabilizer system allows greater freedom in diaphragm/cone selection.

With reference to FIGS. 4 and 5, the concentric tube stabilizer 40 facilitates alternative loudspeaker designs incorporating flatter diaphragms 12 for a more shallow speaker. By incorporating the concentric tube stabilizer 40, the spider can be attached much closer to the back of the speaker 10, affording the employment of a flat or shallow diaphragm 12'. The shallow diaphragm 12' provides a flat or larger cone angle, which allows the motor 26 to be shifted upward into the speaker near the typical cone apex/neck joint to minimize wasted space. As a consequence, a loudspeaker's mounting depth is drastically reduced for a given diaphragm and spider separation. Shallow loudspeakers provide minimal mounting depth and are very useful in situations where enclosure space is at a premium. Four embodiments of the shallow speaker design are shown in FIGS. 4, 5, 8, and 9*a*.

Figure 9A:
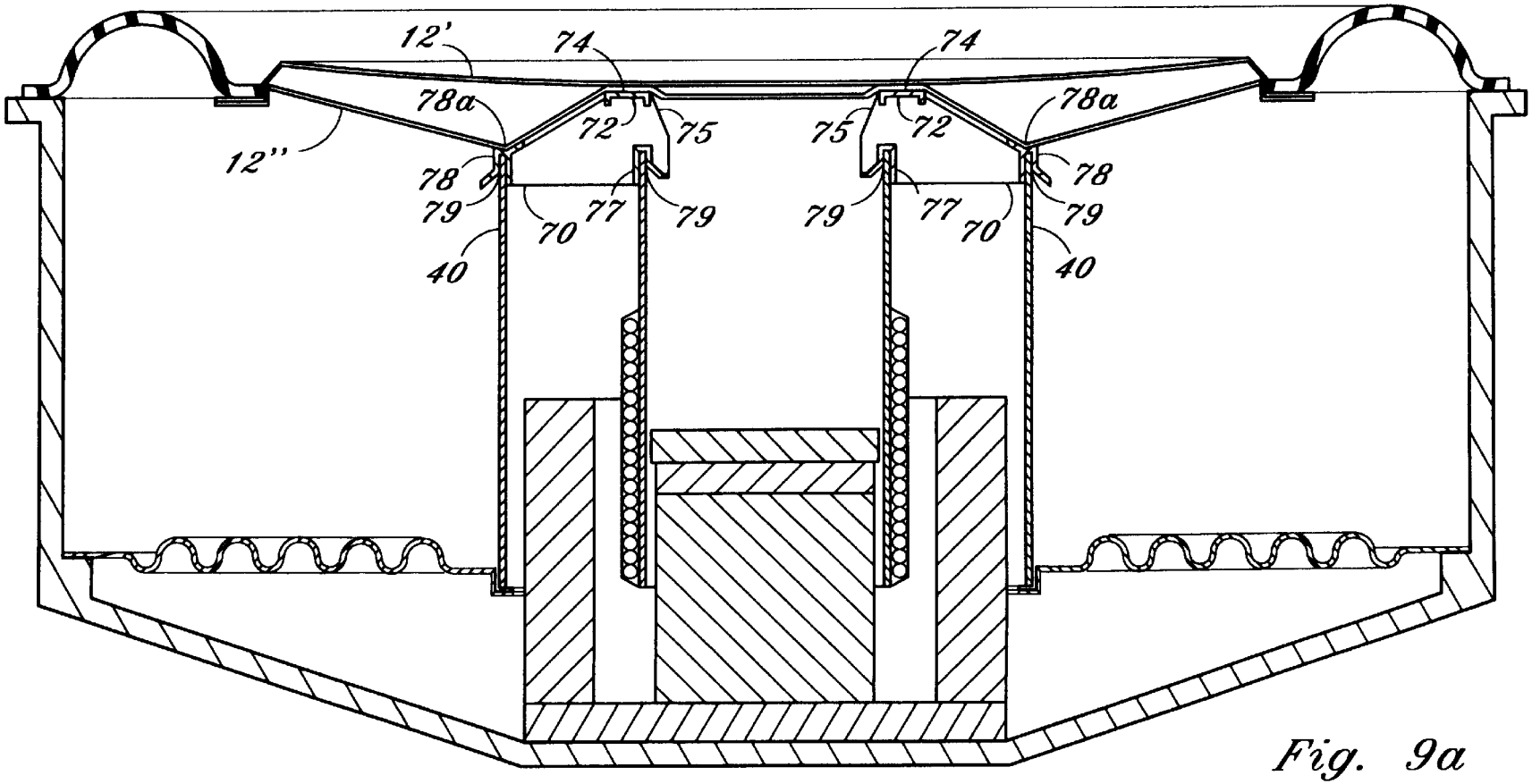
FIG. 9*a* is a cross sectional view of the preferred embodiment of the loudspeaker of the instant invention illustrating a preferred adaptor ring.

With the shallow speaker design, a composite diaphragm 12' may be employed, as shown in FIGS. 4, 5, and 9*a* (dual-skin diaphragm may be considered to be a composite). In the composite diaphragm design, the concentric elbow is eliminated and an alternative stabilizer attaching means is preferably used. In one embodiment, the concentric tube stabilizer 40 may be attached to the composite cone 12' by adhesive impregnated foam 50. The impregnated foam 50 comprises a top surface adaptable for attachment to the diaphragm 12' and a bottom surface which is penetrable by the tube stabilizer 40 for forming a slit or penetrating a prefabricated slit. This slit is adapted to receive the stabilizer 40 and adhesives for an enhanced glue joint. The foam 50 may comprise a plurality of foam strips around the upper stabilizer end 42 and diaphragm or it may comprise a single annular ring having a central diameter substantially equal to the stabilizer 40 diameter. The impregnated foam 50 is permanently secured to the stabilizer's upper edge 42 by filling the slit with a conventional adhesive or epoxy. The impregnated foam 50 is also adhered to the bottom surface 12*b*' of the composite diaphragm 12' with conventional adhesives. The impregnated foam 50 provides a greater surface area than the stabilizer's upper edge 42 for attaching to the composite diaphragm 12'. The foam 50 may also be used as an attaching means for adhering the stabilizer to the cone-like diaphragm 12 shown in FIG. 3. Likewise, the voice coil former 22 may be attached to the composite cone 12' with a second adhesive impregnated foam 50. Collectively, the shallow composite cone 12', the impregnated foam 50, and the suspension system incorporating the concentric stabilizer 40 provide resistance to rocking and decrease the likelihood of the voice coil 40 rubbing the motor structure or top plate.

Figure 6:
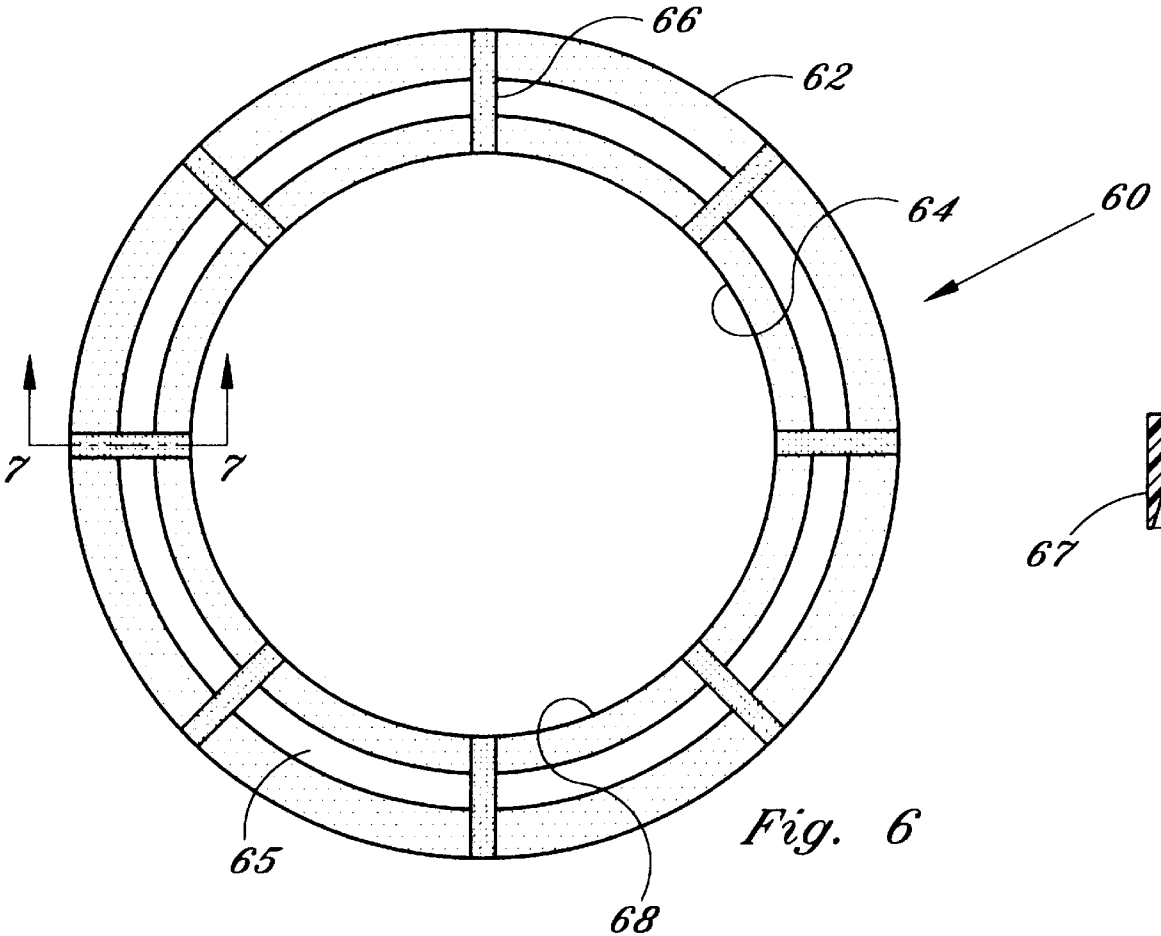
FIG. 6 is a top planar view of one ventilation adaptor ring.

In another embodiment, the instant invention may incorporate an adaptor ring 60 like that shown in FIG. 6. The adaptor ring comprises dual concentric rings 62, 64. The inner concentric ring 64 and outer concentric ring 62 are joined by a plurality of support ribs 66 that project upward from the rings 62, 64. The ribs 66 have free top ends which are adhered to the bottom of the diaphragm 12 or 12'. Accordingly, the ribs' 66 top end should be flat and provide some surface area. Each pair of ribs 66 defines a horizontal and vertical ventilation channel 65*b* and 65*a*, respectively, when the adaptor ring 60 is attached to the composite diaphragm 12'. The ventilation channel 65*b* provides a pressure relief path from the primary volume defined by the diaphragm 12', the inner diameter of the voice coil 22, and the top plate 29. The secondary volume defined by the outer diameter of the voice coil 22, the inner diameter of the concentric tube 40, and the top of the motor pot wall 26 can vent through two paths. One path is through the vertical vent channel 65*a*. The second path 27 is defined between the inner diameter of the concentric tube 40 and the outer diameter of the motor structure. However, the secondary volume may not be able to vent freely through the second path 27 due to the close proximity of the parts. Pole vents are therefore not required in the motor structure 28. The adaptor ring 60 may be attached to the composite diaphragm 12' with conventional adhesives or foam.

Figure 7:
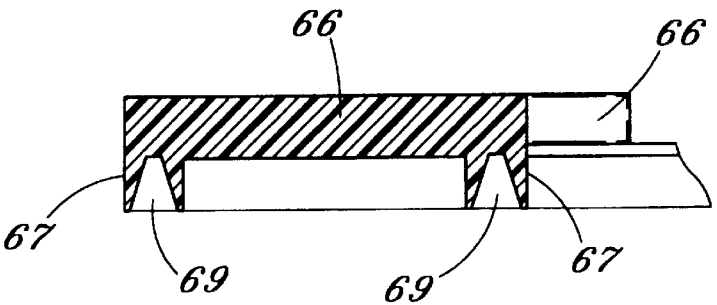
FIG. 7 is a cross sectional view of the adaptor ring taken along line 7—7 of FIG. 6, illustrating the adhesive reservoirs.

The adaptor ring 60 receives and secures both the stabilizer 40 and former 22. With reference to FIG. 7, the ring 60 comprises a pair of continuous depending annular tabs 67 which are in tubular relation with either the voice coil former 22 or the stabilizer 40. Each tab 67 defines an annular trough/reservoir 69 for respectively receiving the concentric tube stabilizer 40 and the voice coil former 22 in the throat of the reservoirs 69. Accordingly, the first annular tab 67 projects downwardly from the outer ring 62 in alignment with the stabilizer 40, while the second annular tab 67 projects downwardly from the inner ring 64 in alignment with the former 22. As shown in FIG. 5, each reservoir 69 is adapted for receiving an adhesive to adhere the stabilizer 40 and the former 22, respectively. In the alternative, the tabs 67 may comprise a plurality of discontinuous reservoir troughs, which may or may not be in alignment with the ribs 66. In either event, the spider suspension 30 attaches to the stabilizer 40, as previously discussed, to collectively provide the stabilizing force needed for unencumbered linear travel of the moving assembly.

Figure 8:
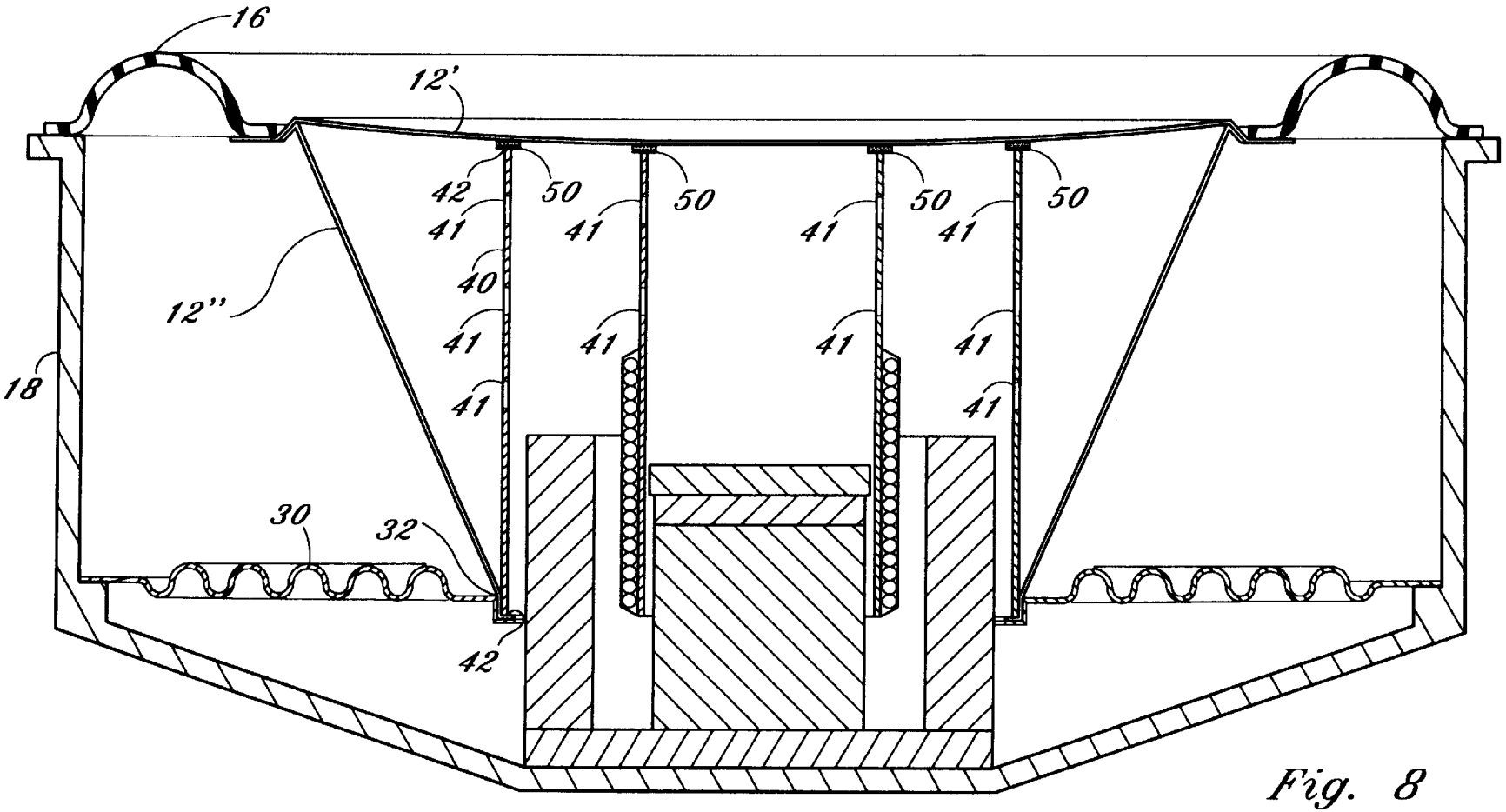
FIG. 8 is a cross sectional view of another embodiment of the invention.

With reference to FIG. 8, another loudspeaker embodiment may be employed with the stabilizer 40 and hence suspension system of the instant invention. In this embodiment, the stabilizer 40 facilitates the incorporation of an inner cone 12" and an outer skin 12' in a loudspeaker configuration. The inner cone 12" defines a raised section at its upper corner which sharply angles downward at its apex toward the stabilizer's lower end 44. The lower end 44 is structurally adapted for simultaneously attaching the inner cone 12" and the spider 30 along its inner edge 32. The outer skin 12' bridges across the inner cone. The outer edge of both the outer skin 12' and inner cone are attached to the roll. This embodiment provides the benefits of a deeper cone diaphragm without the drawbacks of having to connect the cone to the voice coil former 22. Rather, the stabilizer 40 secures the cone 12" with a stronger more reliable attachment than that provided by the voice coil former. The upper end 42 of the stabilizer 40 may be attached to the outer skin 12' by any of the attaching means discussed herein.

Still referring to FIG. 8, the stabilizer 40 and former 22, in this embodiment, may define a plurality of apertures, openings, or vents 41 for releasing air pressure in the former volume. The vents 41 provide a path to ambient. It should be noted that a pole vent in the motor structure may be alternatively employed. Ventilation vents may also be defined by the impregnated foam 50 or by voids defined by strips of foam 50. If the foam 50 is continuous, it would include vent passages 41. On the other hand, discontinuous foam 50 would define open space between the strips 52 to vent air pressure.

Figure 9B:
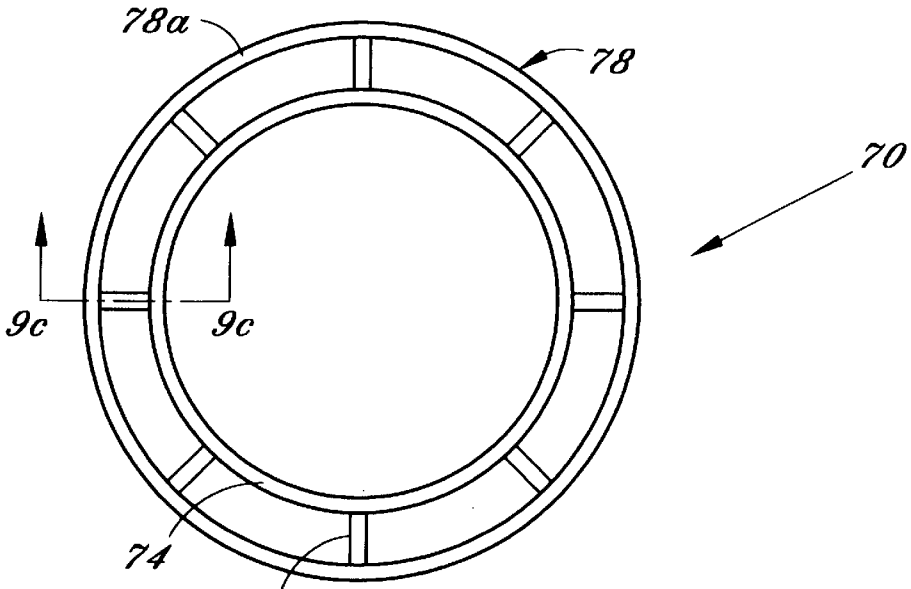
FIG. 9*b* is a top planar view of the preferred adaptor ring.
Figure 9C:
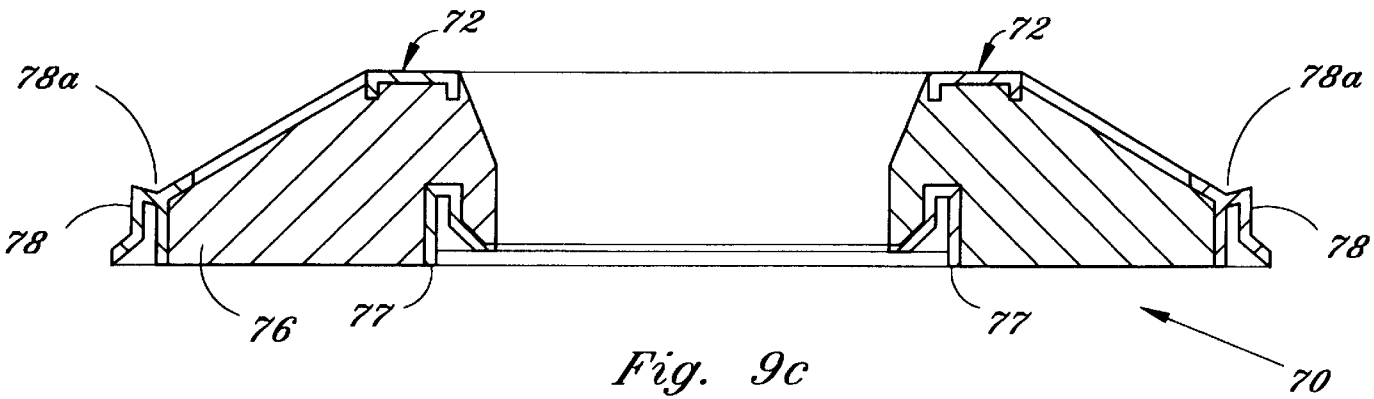
FIG. 9*c* is a cross sectional view of the preferred adaptor taken along line 9*c*—9*c* of FIG. 9*b*.

In the preferred embodiment, the adaptor ring may comprise a substantially conical, truncated, vented ring 70, as shown in FIGS. 9*a*–9*c* for use with a cone structure 12" as shown in FIG. 9*a* and similar to that shown in FIG. 8. The preferred adaptor ring 70 is substantially cone-shaped with a truncated/flat top surface 74. The alternative adaptor ring 70 essentially comprises an upper ring 72, an inner annular trough 77, and an outer annular trough 78, all of which are periodically joined and secured by a plurality of ribs 76. The upper ring 72 defines the truncated/flat surface 74 and has sufficient thickness and a plurality of periodic depending feet for reinforcement and stability. The top surface 74 is adhered to the cone diaphragm 12" by conventional means. The troughs 77, 78 comprise annular sleeves, each of which define an outer flange to which the ribs 76 are joined. The inner trough 77 forms a reservoir 79 which is in alignment with and receives and adheres the former 22. The outer trough 78 defines a reservoir 79 for receiving and adhering the stabilizer 40. The ribs 76 hold the annular members 72, 77, and 78 in place and help to define venting channels 75 for removing air pressure buildup between the diaphragm, the voice coil ID, and the top plate. The top edge of each rib 76 is recessed below the cone 12" so that only the upper ring 72 and upper surface of the outer trough 78*a* are adhered to the cone. The trough upper surface 78*a* preferably defines a contour that complements secured attachment of the cone 12". The adaptor ring 70 provides another way of venting heat compared to the adaptor ring 60 discussed above. Air is vented through the path or passage 75 when the cone moves downward. Air exits through the inner radial opening over the former 22 and inner trough 77 and out between the motor outer diameter and stabilizer 40. This movement of air aids in cooling by passing over a larger surface area of the motor for enhanced heat exchange. The adaptor rings 60, 70 are preferably manufactured by an injection molded plastic.

The concentric tube stabilizer may be manufactured from paper, craft paper, or Nomex™. The concentric tube stabilizer thus defines a paper-like tube, adaptable for attachment to the cone by the attaching means described herein. In the alternative, the concentric tube stabilizer 40 may comprise a plastic, injection-molded structure for attaching the diaphragm and spider. An injection molded part makes many additional variations in spider/cone attachment and pressure ventilation possible while enhancing component rigidity. Because the injection molding process will allow one to shape the stabilizer 40 as desired, there is greater flexibility in the design of the stabilizer 40, such as venting options.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A loudspeaker, comprising:

a frame;

a motor structure having a magnetic gap, and a voice coil including a former having an inner surface defining a hollow interior and an outer surface which carries a wire winding, said wire winding having an uppermost winding, a lowermost winding and a number of intermediate windings therebetween;

an upper suspension connected to said frame, a diaphragm connected to said upper suspension, a lower suspension having a first end connected to said frame and a second end;

a stabilizer tube having an upper end, a lower end and a hollow interior, said upper end being connected to said diaphragm so that said motor structure is disposed within at least a portion of said hollow interior of said stabilizer tube;

said diaphragm extending from said stabilizer tube into engagement with said voice coil so that said voice coil is suspended at least partially within said magnetic gap of said motor structure; and said second end of said lower suspension being connected to said stabilizer tube at a location vertically below said uppermost winding of said wire winding on said outer surface of said former of said voice coil.

2. The loudspeaker of claim 1 in which said second end of said lower suspension is connected to said lower end of said stabilizer tube.

3. The loudspeaker of claim 1 in which said diaphragm has a first end connected to said upper suspension and a second end connected to said voice coil, said stabilizer tube being connected to said diaphragm at a location intermediate said first and second ends.

4. The loudspeaker of claim 1 in which said voice coil has a top end, said diaphragm being connected to said upper end of said stabilizer tube and to said top end of said voice coil.

5. The loudspeaker of claim 4 in which said upper end of said stabilizer tube and said top end of said voice coil are substantially co-planer.

6. The loudspeaker of claim 4 in which each of said stabilizer tube and said voice coil are formed with vent bores for venting air.

7. A loudspeaker comprising:

a frame;

a motor structure having a magnetic gap, and a voice coil including a former having an inner surface defining a hollow interior and an outer surface which carries a wire winding, said wire winding having an uppermost winding, a lowermost winding and a number of intermediate windings therebetween;

an upper suspension connected to said frame, a diaphragm connected to said upper suspension, a lower suspension having a first end connected to said frame and a second end;

a stabilizer tube having an upper end, a lower end and a hollow interior, said upper end being connected to said diaphragm so that said motor structure is disposed within at least a portion of said hollow interior of said stabilizer tube;

an adaptor ring carried by said diaphragm, said adaptor ring being connected to said stabilizing tube and to said voice coil so that said voice coil is suspended at least partially within said magnetic gap of said motor structure; and said second end of said lower suspension being connected to said stabilizer tube at a location vertically below said uppermost winding of said wire winding on said outer surface of said former of said voice coil.

8. The loudspeaker of claim 7 in which said adaptor ring includes a number of circumferentially spaced tabs forming vent passages therebetween, said tabs being connected to said stabilizer tube and to said voice coil.

9. The loudspeaker of claim 8 in which said voice coil has a top end, said tabs of said adaptor ring being connected to said upper end of said stabilizer tube and to said top end of said voice coil.

10. The loudspeaker of claim 7 in which said second end of said lower suspension is connected to said lower end of said stabilizer tube.

11. A loudspeaker, comprising:

a frame;

a motor structure having a magnetic gap, and a voice coil including a former having an inner surface defining a hollow interior and an outer surface which carries a wire winding, said wire winding having an uppermost winding, a lowermost winding and a number of intermediate windings therebetween;

an upper suspension connected to said frame, an inner diaphragm and an outer diaphragm each connected to said upper suspension, a lower suspension having a first end connected to said frame and a second end;

a stabilizer tube having an upper end, a lower end and a hollow interior, said stabilizer tube being connected to at least one of said inner diaphragm and said outer diaphragm so that said motor structure is disposed within at least a portion of said hollow interior of said stabilizer tube;

at least one of said inner diaphragm and said outer diaphragm being connected to said voice coil so that said voice coil is suspended at least partially within said magnetic gap of said motor structure; and said second end of said lower suspension being connected to said stabilizer tube at a location vertically below said uppermost winding of said wire winding on said outer surface of said former of said voice coil.

12. The loudspeaker of claim 11 in which said lower suspension is connected to said lower end of said stabilizer tube.

13. The loudspeaker of claim 11 in which said inner diaphragm is connected to said lower end of said stabilizer tube.

14. The loudspeaker of claim 11 in which said outer diaphragm is connected to said upper end of said stabilizer tube.

15. The loudspeaker of claim 14 in which said voice coil has a top end, said outer diaphragm being connected to said top end of said voice coil.

16. The loudspeaker of claim 15 in which said upper end of said stabilizer tube and said top end of said voice coil are substantially co-planer.

17. The loudspeaker of claim 11 in which each of said stabilizer tube and said voice coil are formed with vent bores for venting air.

18. The loudspeaker of claim 11 further including an adaptor ring connected to said inner diaphragm, said adaptor ring being formed with an outer trough connected to said upper end of said stabilizer tube and an inner trough connected to said voice coil.

* * * * *